US011512375B2

(12) United States Patent
Imanami

(10) Patent No.: US 11,512,375 B2
(45) Date of Patent: Nov. 29, 2022

(54) CASE HARDENING STEEL

(71) Applicant: JFE Steel Corporation, Tokyo (JP)

(72) Inventor: Yuta Imanami, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 14/780,702

(22) PCT Filed: Jan. 16, 2014

(86) PCT No.: PCT/JP2014/000191

§ 371 (c)(1),
(2) Date: Sep. 28, 2015

(87) PCT Pub. No.: WO2014/155906

PCT Pub. Date: Oct. 2, 2014

(65) Prior Publication Data

US 2016/0060737 A1 Mar. 3, 2016

(30) Foreign Application Priority Data

Mar. 29, 2013 (JP) ..... JP2013-074347

(51) Int. Cl.

| | |
|---|---|
| ***C22C 38/48*** | (2006.01) |
| ***C22C 38/42*** | (2006.01) |
| ***C22C 38/32*** | (2006.01) |
| ***C22C 38/26*** | (2006.01) |
| ***C22C 38/24*** | (2006.01) |

(Continued)

(52) U.S. Cl.

CPC ..... *C22C 38/54* (2013.01); *C21D 1/06* (2013.01); *C22C 38/00* (2013.01); *C22C 38/001* (2013.01);

(Continued)

(58) Field of Classification Search

CPC ..... C21D 1/06

See application file for complete search history.

(56) References Cited

U.S. PATENT DOCUMENTS 4,634,573 A * 1/1987 Yanagiya ..... C21D 8/00 148/319
2002/0007882 A1* 1/2002 Inoue ..... C21D 8/0226 148/541

(Continued)

FOREIGN PATENT DOCUMENTS

EP 2 530 178 12/2012
JP 09-256102 A 9/1997

(Continued)

OTHER PUBLICATIONS

Supplementary European Search Report dated Mar. 18, 2016, of corresponding European Application No. 14774668.9.

(Continued)

*Primary Examiner* — Anthony M Liang
(74) *Attorney, Agent, or Firm* — DLA Piper LLP (US)

(57) ABSTRACT

A case hardening steel includes a chemical composition containing C: 0.10 mass % to 0.35 mass %, Si: 0.01 mass % to 0.13 mass %, Mn: 0.30 mass % to 0.80 mass %, P: 0.02 mass % or less, S: 0.03 mass % or less, Al: 0.01 mass % to 0.045 mass %, Cr: 0.5 mass % to 3.0 mass %, B: 0.0005 mass % to 0.0040 mass %, Nb: 0.003 mass % to 0.080 mass %, N: 0.0080 mass % or less, Ti as an impurity: 0.005 mass % or less, and the balance being Fe and incidental impurities, and satisfying Formulae (1) and (2):

$$3.0[\%\ Si]+9.2[\%\ Cr]+10.3[\%\ Mn]\geq 10.0 \quad (1)$$

$$3.0[\%\ Si]+1.0[\%\ Mn]<1.0 \quad (2)$$

where [% M] represents the content of element M (mass %).

4 Claims, 3 Drawing Sheets

(51) Int. Cl.

| | |
|---|---|
| ***C22C 38/54*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/20*** | (2006.01) |
| ***C22C 38/28*** | (2006.01) |
| ***C22C 38/46*** | (2006.01) |
| ***C22C 38/50*** | (2006.01) |
| ***C23C 8/22*** | (2006.01) |
| ***C21D 1/06*** | (2006.01) |

(52) U.S. Cl.

CPC ..... *C22C 38/002* (2013.01); *C22C 38/02* (2013.01); *C22C 38/04* (2013.01); *C22C 38/06* (2013.01); *C22C 38/20* (2013.01); *C22C 38/24* (2013.01); *C22C 38/26* (2013.01); *C22C 38/28* (2013.01); *C22C 38/32* (2013.01); *C22C 38/42* (2013.01); *C22C 38/46* (2013.01); *C22C 38/48* (2013.01); *C22C 38/50* (2013.01); *C23C 8/22* (2013.01)

(56) References Cited

U.S. PATENT DOCUMENTS

2010/0282373 A1* 11/2010 Van Tol ..... C23C 2/06 148/527

2015/0017471 A1* 1/2015 Shuto ..... C22C 38/002 428/659

FOREIGN PATENT DOCUMENTS

| | | | |
|---|---|---|---|
| JP | 11-012684 | | 1/1999 |
| JP | 2003-183773 | A | 7/2003 |
| JP | 3623313 | B2 | 2/2005 |
| JP | 2005-256082 | A | 9/2005 |
| JP | 3764586 | B2 | 4/2006 |
| JP | 2006-152330 | A | 6/2006 |
| JP | 2010-222634 | A | 10/2010 |
| JP | 2013019048 | A * | 1/2013 |

OTHER PUBLICATIONS

Chinese Office Action dated Apr. 27, 2016, of corresponding Chinese Application No. 201480018452.0, along with an English translation of the Search Report.

Japanese Office Action dated Feb. 10, 2015 in corresponding Japanese Patent Application No. 2013-074347 with English translation.

Chinese Office Action dated Dec. 14, 2016, of corresponding Chinese Application No. 201480018452.0, along with a Search Report in English.

* cited by examiner

Notched Part

CASE HARDENING STEEL

TECHNICAL FIELD

The disclosure relates to a case hardening steel applied for machine structure components used in the field of construction machinery and automobiles, in particular, to a case hardening steel having excellent cold forgeability and excellent fatigue strength after carburizing treatment.

BACKGROUND

Since automobile components or the like are often produced by cold forming a steel bar, the material therefor is required to have good cold forgeability. Therefore, the material is normally subjected to softening annealing to spheroidize carbide and improve cold forgeability. Further, in terms of the chemical composition of steel, proposals have been made to reduce the content of Si which greatly affects deformation resistance.

JP3623313B discloses that, by reducing Si content and, further by reducing the amount of other alloying elements to such an extent as to compensate for the quench hardenability improving effect provided by dissolved B, hardness is decreased and cold forgeability is improved.

Further, JP3764586B proposes a case hardening steel ensuring cold workability obtained by combining a chemical composition where Si and Mn which are solid-solution-strengthening elements are reduced and quench hardenability is ensured by dissolved B, with certain production conditions.

The techniques disclosed in JP '313 and JP '586 utilize the quench hardenability improving effect provided by B. However, the quench hardenability improving effect of B is greatly influenced by the cooling rate. On the other hand, since most cold-forged products have complicated shapes, the cooling rate inside components at the time of carburizing and quenching tends to become non-uniform and, as a result, dimensional accuracy after carburizing treatment decreases or component strength becomes insufficient.

Further, although Ti is added to prevent a reduction in the quench hardenability improving effect of B, since nitrides of Ti are generated in the solidification stage of casting, they tend to become coarse, and become the origin of fatigue fracture to shorten the lifetime of components.

It could thus be helpful to provide a case hardening steel exhibiting good cold forgeability and having excellent fatigue strength after carburizing treatment.

SUMMARY

We discovered that by applying an appropriate chemical composition and appropriately managing the addition amount of Si, Cr, and Mn, a case hardening steel with excellent cold forgeability and fatigue strength can be obtained.

We thus provide:

(1) A case hardening steel having a chemical composition containing
C: 0.10 mass % to 0.35 mass %,
Si: 0.01 mass % to 0.13 mass %,
Mn: 0.30 mass % to 0.80 mass %,
P: 0.02 mass % or less,
S: 0.03 mass % or less,
Al: 0.01 mass % to 0.045 mass %,
Cr: 0.5 mass % to 3.0 mass %,
B: 0.0005 mass % to 0.0040 mass %, Nb: 0.003 mass % to 0.080 mass %, and
N: 0.0080 mass % or less
in a range satisfying following formulas (1) and (2),
Ti as an impurity: 0.005 mass % or less, and
the balance being Fe and incidental impurities:

$$3.0[\%\ Si]+9.2[\%\ Cr]+10.3[\%\ Mn]\geq 10.0 \quad (1)$$

$$3.0[\%\ Si]+1.0[\%\ Mn]<1.0 \quad (2)$$

where [% M] represents the content of element M (mass %).

(2) The case hardening steel according to aspect (1) wherein the chemical composition further contains one or more of
Cu: 0.5 mass % or less,
Ni: 0.5 mass % or less, and
V: 0.1 mass % or less.

A case hardening steel with both excellent cold forgeability and high fatigue strength can be provided.

REFERENCE SIGNS LIST

1 V-shaped Groove
2 Surfaces to be Compressed (Top and Bottom Surfaces)
3 Conical Recesses (Restraint Recesses)

DETAILED DESCRIPTION

In the following, reasons for the limiting the steel composition of the case hardening steel to the aforementioned range will be explained in detail.

C: 0.10 mass % to 0.35 mass %

To perform quenching after carburizing heat treatment on the cold-forged product to increase the hardness of the central part of the forged product, 0.10 mass % or more of C is required. On the other hand, if C content exceeds 0.35 mass %, toughness of the core decreases, and therefore C content is limited to 0.10 mass % to 0.35 mass %. The C content is preferably 0.25 mass % or less, and more preferably 0.20 mass % or less.

Si: 0.01 mass % to 0.13 mass %

Si is required as a deoxidizing agent, and needs to be added in an amount of at least 0.01 mass %. However, Si is an element preferentially oxidized in the carburized surface layer and facilitates grain boundary oxidization. Further, it causes solid solution strengthening of ferrite and increases deformation resistance to deteriorate cold forgeability. Therefore, the upper limit of Si content is 0.13 mass %. The Si content is preferably 0.02 mass % to 0.10 mass %, and more preferably 0.02 mass % to 0.09 mass %.

Mn: 0.30 mass % to 0.80 mass %

Mn is an effective element to improve quench hardenability, and needs to be added in an amount of at least 0.30 mass %. However, since excessive addition of Mn results in an increase in deformation resistance caused by solid solution strengthening, the upper limit of Mn content is 0.80 mass %. The Mn content is preferably 0.60 mass % or less, and more preferably 0.55 mass % or less.

P: 0.02 mass % or less

Since P segregates in crystal grain boundaries and reduces toughness, it is desirable for the content thereof to be as low as possible. However, a content thereof of up to 0.02 mass % is tolerable. The P content is preferably 0.018 mass % or less. Further, although a lower limit thereof does not need to be limited to a particular value, considering that unnecessary reduction of P lengthens refining time and increases refining costs, P content should be 0.012% or more.

S: 0.03 mass % or less

S is an element existing as a sulfide inclusion and effective in improving machinability by cutting. However, since excessively adding S would lead to a reduction of cold forgeability, the upper limit thereof is 0.03 mass %. Further, although there is no particular lower limit, it may be set to 0.012% or more for the purpose of guaranteeing machinability by cutting.

Al: 0.01 mass % to 0.045 mass %

If Al is excessively added, it fixes with N within steel as AlN, and develops a quench hardenability improving effect provided by B. To stabilize component strength after carburizing treatment, it is important to prevent the development of the quench hardenability improving effect provided by B, and to do so, the upper limit of Al needs to be 0.045 mass %.

Figure 1:
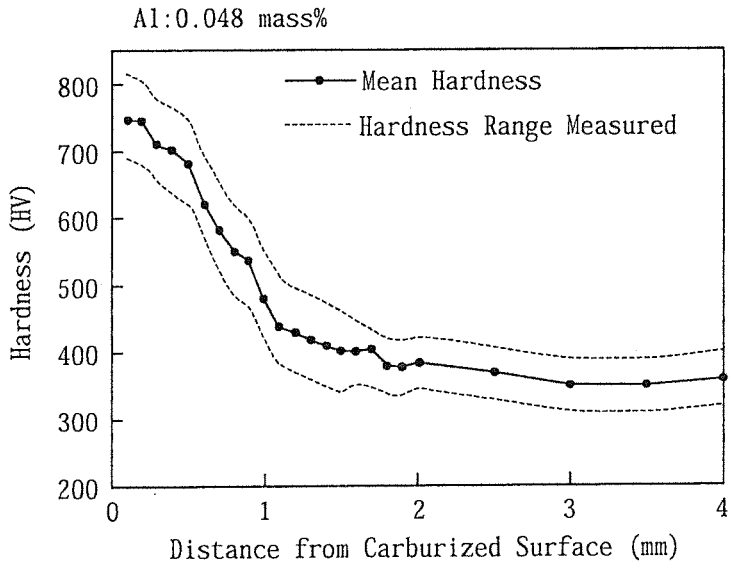
FIG. 1 is a graph showing the mean hardness of a material after carburizing made from a steel material containing 0.048 mass % of Al, in positions from the surface to a position 4 mm inside the material, and the hardness range measured.
Figure 2:
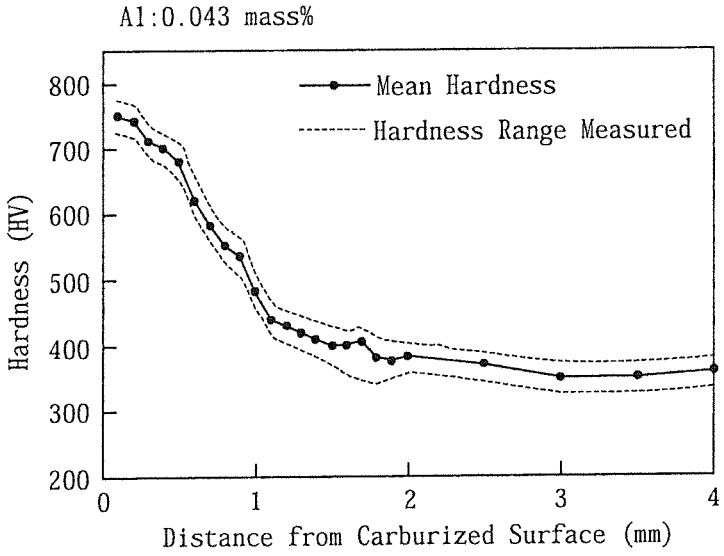
FIG. 2 is a graph showing the mean hardness of a material after carburizing made from a steel material containing 0.043 mass % of Al, in positions from the surface to a position 4 mm inside the material, and the hardness range measured.

The mean hardness of materials after carburizing, each containing 10 ppm of B and 45 ppm of N, and with an Al addition amount of 0.048 mass % (FIG. 1) and 0.043 mass % (FIG. 2), respectively, in positions from the surface to a position 4 mm inside the material, and the hardness range measured are shown in FIGS. 1 and 2.

As is clear from FIGS. 1 and 2, when the Al content is 0.048 mass % (FIG. 1), the hardness range measured (the range between the upper and lower broken lines in the figure) in each depth position from the surface (the horizontal axis in the figure) is larger than that of when the Al content is 0.043 mass % (FIG. 2), and there is a large variation in hardness in each depth position.

Figure 3:
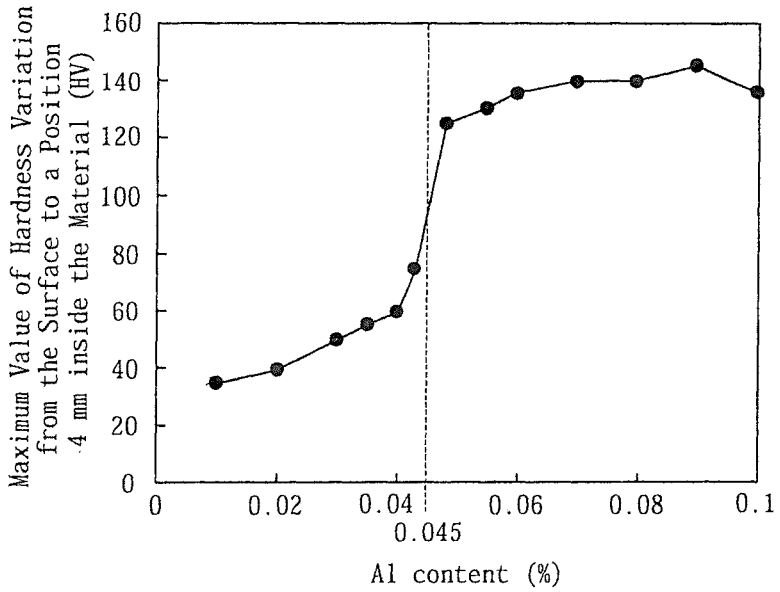
FIG. 3 is a graph showing the relationship between Al content and the maximum value of hardness variation.

FIG. 3 shows the changes in the maximum value of hardness variation (the maximum value in the vertical axis direction between the upper and lower broken lines in FIG. 1 or 2) when 10 ppm of B and 45 ppm of N are contained with varying Al addition amounts.

As is clear from FIG. 3, by setting the Al addition amount to 0.045 mass % or less, the variation of hardness from the surface of the material after carburizing to the inside thereof is reduced. Based on the above results, the upper limit value of Al content is set to 0.045 mass %.

Experiments for which results are shown in FIGS. 1 to 3 were conducted under the following conditions. The steel used in the experiments contained C: 0.16 mass %, Si: 0.09 mass %, Mn: 0.53 mass %, P: 0.012 mass %, S: 0.012 mass %, Cr: 1.9 mass %, B: 0.0015 mass %, Nb: 0.025 mass %, and N: 0.0065 mass %, the Al addition amount being as described above, and the balance including Fe and incidental impurities. After the steel was processed into a round bar having a diameter of 25 mm, it was subjected to carburizing at 930° C. for 3 hours with a carbon potential of 1.0 mass %, then oil quenched at 60° C., and then tempered at 180° C. for 1 hour. The hardness from the surface of the cross section of the tempered round bar to the position 4 mm inside was measured in the same cross section in 10 areas per depth position to obtain the mean value, maximum value and the minimum value of Vickers hardness in each depth position from the surface.

On the other hand, since Al is an effective element for deoxidization, the lower limit thereof is 0.01 mass %. The content thereof is preferably 0.01 mass % to 0.040 mass %, and more preferably 0.015 mass % to 0.035 mass %.

Cr: 0.5 mass % to 3.0 mass %

Cr contributes to improving not only quench hardenability, but also resistance to temper softening, and is also an effective element to facilitate spheroidization of carbide. However, if Cr content is less than 0.5 mass %, the addition effect is limited. On the other hand, if it exceeds 3.0 mass %, it facilitates excessive carburizing or generation of retained austenite and adversely effects fatigue strength. Therefore, Cr content is limited to 0.5 mass % to 3.0 mass %. It is preferably 0.7 mass % to 2.5 mass %.

B: 0.0005 mass % to 0.0040 mass %

B bonds inside the steel with N and has an effect of reducing dissolved N. Therefore, it is possible to reduce dynamic strain aging at the time of cold forging caused by dissolved N, and contributes to reducing the deformation resistance during forging. 0.0005% or more of B needs to be added to obtain this effect. On the other hand, if B content exceeds 0.0040%, the effect of reducing deformation resistance reaches a plateau, and causes a reduction of toughness. Therefore, B content is limited to 0.0005 mass % to 0.0040 mass %. More preferably, B content is 0.0005 mass % to 0.0030 mass %.

Nb: 0.003 mass % to 0.080 mass %

Nb forms NbC inside the steel, and inhibits grain coarsening of austenite grains during carburizing heat treatment by a pinning effect. It needs to be added in an amount of at least 0.003 mass % to obtain this effect. On the other hand, if Nb is added in an amount exceeding 0.080 mass %, it may result in deterioration of grain coarsening inhibiting ability caused by precipitation of coarse NbC or deterioration of fatigue strength. Therefore, Nb content is 0.080 mass % or less. It is preferably 0.010 mass % to 0.060 mass %, and more preferably 0.015 mass % to 0.045 mass %.

Ti: 0.005 mass % or less

It is important to minimize the Ti content mixed into steel. Ti tends to bond with N to form coarse TiN and, adding Ti simultaneously with Nb, makes it even more likely to generate coarse precipitates and causes a reduction in fatigue strength. Therefore, the upper limit of Ti contained as an impurity is 0.005 mass %. More preferably, Ti content is 0.003 mass % or less.

N: 0.0080 mass % or less

Since N dissolves in steel to cause dynamic strain aging during cold forging to increase deformation resistance, it needs to be minimized. Therefore, the amount of N mixed in is limited to 0.0080 mass % or less. The N content is preferably 0.0070 mass % or less, and more preferably 0.0065 mass % or less.

The proper composition ranges of the basic components are as explained above. However, it does not suffice for each element to only satisfy the aforementioned ranges, and it is also important for Si, Mn, and Cr, in particular, to satisfy the relationships of Formulae (1) and (2):

$$3.0[\%\ Si]+9.2[\%\ Cr]+10.3[\%\ Mn]\geq 10.0 \quad (1)$$

$$3.0[\%\ Si]+1.0[\%\ Mn]<1.0 \quad (2)$$

where [% M] represents the content of element M (mass %).

Formula (1) relates to factors that influence quench hardenability and temper softening resistancy, and if Formula (1) is not satisfied, fatigue strength after carburizing treatment becomes insufficient. Further, Formula (2) relates to factors that influence cold forgeability, and if Formula (2) is satisfied, solid solution strengthening caused by Si and Mn can be inhibited, and thereby deformation resistance during cold forging can be reduced and die life can be enhanced.

Figure 4:
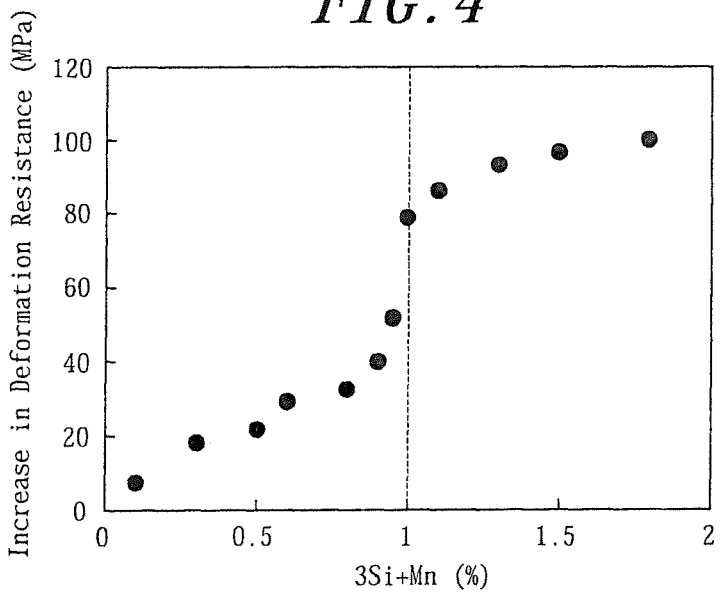
FIG. 4 is a graph showing the relationship between the balance of addition amounts of Si and Mn, and the increase in deformation resistance.

The increase in deformation resistance was calculated for when only the addition amounts of Si and Mn were changed, compared to when Si and Mn are not added. As can be seen from the results shown in FIG. 4, when 3.0[% Si]+1.0[% Mn] is less than 1, the increase in deformation resistance is surely inhibited. Experiments for which results are shown in FIG. 4 were conducted under the following conditions.

Using a steel containing C: 0.18 mass %, Si: not added, Mn: not added, P: 0.012 mass %, S: 0.012 mass %, Al: 0.034 mass %, Cr: 1.7 mass %, B: 0.0013 mass %, Nb: 0.030 mass %, and N: 0.0052 mass %, and the balance including Fe and incidental impurities as the base material, 12 different steels with varying Si contents in a range of 0.03 mass % to 0.20 mass %, and varying Mn contents in a range of 0.34 mass % to 1.2 mass %, were prepared and hot rolled to a diameter of 40 mm. Then, the deformation resistance thereof was measured with a cold forgeability evaluation method described later, and the increase in deformation resistance was obtained by comparing with the deformation resistance of when Si and Mn are not added.

Although the basic components of the case hardening steel of the disclosure are as explained above, one or more of Cu: 0.5 mass % or less, Ni: 0.5 mass % or less, and V: 0.1 mass % or less may also be contained as necessary.

Since Cu is an effective element to improve quench hardenability, it is preferably added in an amount of 0.05 mass % or more. However, excessively adding Cu causes deterioration of surface characteristics of the steel sheet and increases alloy costs. Therefore, the upper limit thereof is 0.5 mass %.

Since Ni and V are effective elements to improve quench hardenability and toughness, they are preferably contained respectively in amounts of 0.05 mass % or more and 0.01 mass % or more. However, since they are expensive, the upper limits of the content thereof are each limited to 0.5 mass % and 0.1 mass %.

EXAMPLES

In the following, the constitution and effect of the case hardening steel will be explained in more detail with reference to the examples. However, the case hardening steel is not restricted by any means to these examples, which may be changed appropriately within the range conforming to the purpose of the disclosure, all of such changes being included within the technical scope of this disclosure.

A steel having a chemical composition shown in Table 1 was obtained by steel-making, and a bloom produced from the molten steel thereof was subjected to hot rolling and formed into a steel bar of 40 mmφ. Evaluation on cold forgeability was performed for the obtained steel bar.

Cold forgeability was evaluated based on two criteria, namely, deformation resistance and critical upset ratio.

Figure 5A:
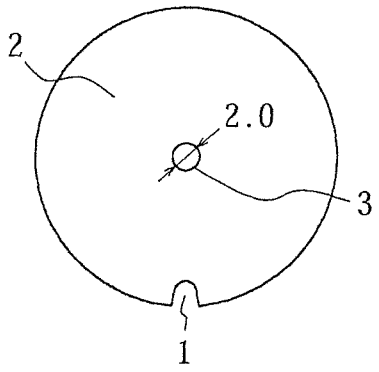
FIGS. 5A, 5B and 5C show the shape of the V-grooved cold forgeability test piece for evaluation of critical upset ratio.
Figure 5B:
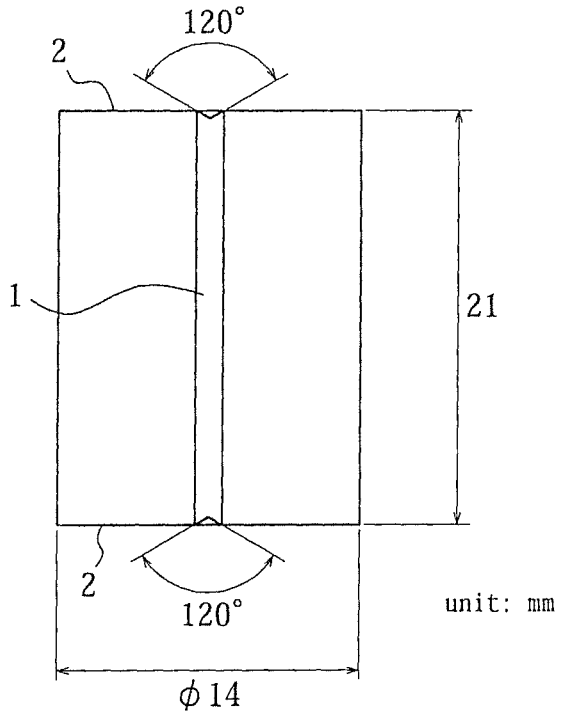
Figure 5C:
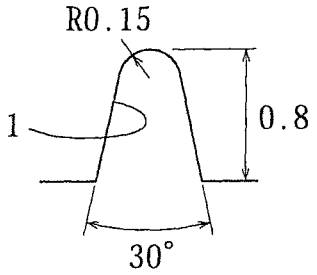

Test pieces each being in a columnar shape of 15 mm in diameter and 22.5 mm in height were collected from the steel bars as rolled, the test pieces each having the center axis positioned at a depth of ¼ of the diameter D of the steel bar (hereinafter, this position is referred to as "¼D position") from the outer periphery thereof. The columnar test pieces thus obtained each had conical recesses formed at the center positions on the top and bottom surfaces thereof, the conical recesses each having a bottom surface of 2 mmφ in diameter and having a central angle of 120°. The recesses thus formed were configured to serve as restraint recesses. The columnar test pieces each further have a V-shaped groove in the side surface thereof, the groove extending in the height direction of the test piece so that the test piece was obtained as a notched columnar test piece. FIG. 5A is a top view illustrating the shape of the notched columnar test piece used to evaluate the cold forgeability, FIG. 5B is a side view thereof, and FIG. 5C is a view illustrating the detailed dimensions of the V-shaped groove of FIG. 5B. In the drawings, reference numeral 1 denotes the V-shaped groove, 2 denotes the surfaces to be compressed (top and bottom surfaces), and 3 denotes the conical recesses (restraint recesses).

The cold forgeability was evaluated as follows. That is, the test pieces were each subjected to compression test in which a compressive load was applied to each of the two surfaces 2 to be compressed in a state where the top and bottom surfaces of the test piece were restrained, to thereby measure deformability and deformation resistance. Deformability was evaluated based on the maximum compressibility to crack initiation from the floor of the V-groove 1 (referred to as critical upset ratio), while deformation resistance was evaluated based on a deformation stress at a compressibility of 60% (referred to as "60% deformation resistance"). The steel can be considered excellent in cold forgeability when the critical upset ratio is 50% or more and the deformation resistance value is 800 MPa or less.

Next, fatigue properties were evaluated based on two points namely, bending fatigue and surface fatigue.

From the ¼ D position of the above steel bar, a rotary bending test piece to evaluate bending fatigue strength and a roller pitting test piece to evaluate surface fatigue strength were collected. These test pieces were subjected to carburizing at 930° C. for 3 hours with a carbon potential of 1.0 mass %, then oil quenched at 60° C., and then tempered at 180° C. for 1 hour. For each carburized test piece, a rotating bending fatigue test and a roller pitting test was performed. The rotating bending fatigue test was performed at a speed of 3500 rpm and the fatigue limit strength after $10^7$ cycles was evaluated. The roller pitting test was performed under the conditions of a slip rate of 40% and an oil temperature of 80° C., and strength after $10^7$ cycles (critical strength at which pitting occurs in test piece surface) was evaluated. The obtained results are shown in Table 2. With a bending fatigue strength of 800 MPa or more and a surface fatigue strength of 3500 MPa or more, fatigue strength is considered excellent.

As shown in Table 2, all of our examples are excellent in both cold forgeability and fatigue strength.

TABLE 1

| Steel | Chemical Composition (mass %) | | | | | | | | | | | | | | Formula | Formula | |
|---|---|---|---|---|---|---|---|---|---|---|---|---|---|---|---|---|---|
| No. | C | Si | Mn | P | S | Al | N | Cr | B | Nb | Ti | Cu | Ni | V | (1) | (2) | Remarks |
| A | 0.11 | 0.05 | 0.55 | 0.012 | 0.012 | 0.033 | 0.0045 | 1.6 | 0.0021 | 0.028 | 0.001 | — | — | — | 20.2 | 0.70 | Example of Disclosure |
| B | 0.15 | 0.05 | 0.58 | 0.013 | 0.013 | 0.018 | 0.0061 | 1.4 | 0.0018 | 0.022 | 0.001 | 0.12 | — | — | 19.0 | 0.73 | Example of Disclosure |

TABLE 1-continued

| Steel | Chemical Composition (mass %) | | | | | | | | | | | | | | Formula | Formula | |
|---|---|---|---|---|---|---|---|---|---|---|---|---|---|---|---|---|---|
| No. | C | Si | Mn | P | S | Al | N | Cr | B | Nb | Ti | Cu | Ni | V | (1) | (2) | Remarks |
| C | 0.17 | 0.04 | 0.45 | 0.012 | 0.013 | 0.032 | 0.0056 | 1.5 | 0.0010 | 0.035 | 0.001 | — | 0.14 | — | 18.6 | 0.57 | Example of Disclosure |
| D | 0.19 | 0.06 | 0.51 | 0.013 | 0.012 | 0.031 | 0.0075 | 0.5 | 0.0005 | 0.045 | 0.001 | — | — | 0.03 | 10.0 | 0.69 | Example of Disclosure |
| E | 0.22 | 0.13 | 0.34 | 0.012 | 0.012 | 0.045 | 0.0048 | 2.4 | 0.0013 | 0.049 | 0.002 | 0.16 | 0.08 | — | 26.0 | 0.73 | Example of Disclosure |
| F | 0.26 | 0.03 | 0.75 | 0.012 | 0.012 | 0.041 | 0.0019 | 0.6 | 0.0017 | 0.012 | 0.002 | — | 0.10 | 0.02 | 13.3 | 0.84 | Example of Disclosure |
| G | 0.29 | 0.12 | 0.52 | 0.012 | 0.012 | 0.036 | 0.0028 | 1.3 | 0.0018 | 0.032 | 0.001 | — | — | — | 18.0 | 0.88 | Example of Disclosure |
| H | 0.33 | 0.06 | 0.41 | 0.012 | 0.012 | 0.027 | 0.0052 | 3.0 | 0.0015 | 0.078 | 0.001 | — | — | — | 32.0 | 0.59 | Example of Disclosure |
| J | 0.09 | 0.07 | 0.55 | 0.013 | 0.012 | 0.031 | 0.0056 | 0.8 | 0.0010 | 0.021 | 0.001 | — | — | — | 13.2 | 0.76 | Comparative Example |
| K | 0.36 | 0.06 | 0.61 | 0.012 | 0.012 | 0.036 | 0.0071 | 1.5 | 0.0015 | 0.019 | 0.001 | — | — | — | 20.3 | 0.79 | Comparative Example |
| L | 0.26 | 0.14 | 0.64 | 0.012 | 0.012 | 0.038 | 0.0054 | 1.2 | 0.0015 | 0.031 | 0.001 | — | — | — | 18.1 | 1.06 | Comparative Example |
| M | 0.25 | 0.04 | 0.9 | 0.013 | 0.012 | 0.033 | 0.0041 | 1.1 | 0.0011 | 0.024 | 0.002 | — | — | — | 19.5 | 1.02 | Comparative Example |
| N | 0.19 | 0.04 | 0.48 | 0.012 | 0.013 | 0.048 | 0.0045 | 1.5 | 0.0015 | 0.045 | 0.001 | — | — | — | 18.9 | 0.60 | Comparative Example |
| O | 0.21 | 0.010 | 0.53 | 0.013 | 0.012 | 0.027 | 0.0090 | 1.4 | 0.0023 | 0.034 | 0.001 | — | — | — | 18.4 | 0.56 | Comparative Example |
| P | 0.26 | 0.11 | 0.68 | 0.012 | 0.012 | 0.02 | 0.038 | 0.3 | 0.0021 | 0.028 | 0.001 | — | — | — | 10.1 | 1.01 | Comparative Example |
| Q | 0.24 | 0.05 | 0.42 | 0.012 | 0.013 | 0.03 | 0.061 | 3.2 | 0.0009 | 0.018 | 0.002 | — | — | — | 33.9 | 0.57 | Comparative Example |
| R | 0.14 | 0.05 | 0.69 | 0.012 | 0.012 | 0.029 | 0.0045 | 1.6 | 0.0003 | 0.029 | 0.001 | — | — | — | 22.0 | 0.84 | Comparative Example |
| S | 0.15 | 0.09 | 0.49 | 0.013 | 0.012 | 0.035 | 0.0055 | 1.2 | 0.0050 | 0.034 | 0.002 | — | — | — | 16.4 | 0.76 | Comparative Example |
| T | 0.21 | 0.09 | 0.56 | 0.012 | 0.012 | 0.028 | 0.0054 | 1.9 | 0.0013 | 0.090 | 0.001 | — | — | — | 23.5 | 0.83 | Comparative Example |
| U | 0.18 | 0.05 | 0.54 | 0.012 | 0.012 | 0.029 | 0.0029 | 2.2 | 0.0015 | 0.002 | 0.001 | — | — | — | 26.0 | 0.69 | Comparative Example |
| V | 0.31 | 0.09 | 0.69 | 0.013 | 0.012 | 0.029 | 0.0041 | 0.9 | 0.0020 | 0.039 | 0.006 | — | — | — | 15.7 | 0.96 | Comparative Example |
| W | 0.21 | 0.07 | 0.39 | 0.012 | 0.013 | 0.027 | 0.057 | 0.6 | 0.0021 | 0.045 | 0.002 | — | — | — | 9.7 | 0.60 | Comparative Example |
| X | 0.24 | 0.11 | 0.67 | 0.012 | 0.013 | 0.031 | 0.064 | 1.1 | 0.0018 | 0.025 | 0.002 | — | — | — | 17.4 | 1.00 | Comparative Example |

TABLE 2

| | | Cold Forgeability | | Fatigue Strength after Carburizing | | |
|---|---|---|---|---|---|---|
| No. | Steel No. | Deformation Resistance (MPa) | Critical Upset Ratio (%) | Bending Fatigue Strength (MPa) | Surface Fatigue Strength (MPa) | Remarks |
| 1 | A | 701 | 61 | 830 | 3650 | Example of Disclosure |
| 2 | B | 721 | 62 | 840 | 3600 | Example of Disclosure |
| 3 | C | 725 | 56 | 870 | 3710 | Example of Disclosure |
| 4 | D | 741 | 58 | 870 | 3750 | Example of Disclosure |
| 5 | E | 753 | 54 | 910 | 3900 | Example of Disclosure |
| 6 | F | 750 | 60 | 810 | 3550 | Example of Disclosure |
| 7 | G | 755 | 53 | 830 | 3740 | Example of Disclosure |
| 8 | H | 779 | 55 | 920 | 3930 | Example of Disclosure |
| 10 | J | 708 | 68 | 750 | 3420 | Comparative Example |
| 11 | K | 821 | 47 | 790 | 3590 | Comparative Example |
| 12 | L | 830 | 45 | 840 | 3600 | Comparative Example |
| 13 | M | 819 | 49 | 890 | 3680 | Comparative Example |
| 14 | N | 750 | 55 | 810 | 3450 | Comparative Example |
| 15 | O | 815 | 42 | 840 | 3540 | Comparative Example |
| 16 | P | 805 | 48 | 790 | 3400 | Comparative Example |
| 17 | Q | 812 | 54 | 740 | 3560 | Comparative Example |
| 18 | R | 820 | 48 | 820 | 3600 | Comparative Example |
| 19 | S | 740 | 54 | 720 | 3370 | Comparative Example |
| 20 | T | 788 | 53 | 780 | 3300 | Comparative Example |
| 21 | U | 725 | 61 | 840 | 3420 | Comparative Example |

TABLE 2-continued

| No. | Steel No. | Cold Forgeability | | Fatigue Strength after Carburizing | | Remarks |
|---|---|---|---|---|---|---|
| | | Deformation Resistance (MPa) | Critical Upset Ratio (%) | Bending Fatigue Strength (MPa) | Surface Fatigue Strength (MPa) | |
| 22 | V | 780 | 54 | 760 | 3460 | Comparative Example |
| 23 | W | 751 | 58 | 790 | 3420 | Comparative Example |
| 24 | X | 804 | 49 | 830 | 3550 | Comparative Example |

The invention claimed is:

1. A case hardening steel comprising a chemical composition containing

C: 0.10 mass % to 0.35 mass %,

Si: 0.01 mass % to 0.13 mass %,

Mn: 0.30 mass % to 0.80 mass %,

P: 0.02 mass % or less,

S: 0.03 mass % or less,

Al: 0.01 mass % to 0.045 mass %,

Cr: 1.3 mass % to 3.0 mass %,

B: 0.0005 mass % to 0.0040 mass %,

Nb: 0.003 mass % to 0.080 mass %,

N: 0.0080 mass % or less,

Ti as an impurity: 0.005 mass % or less, and the balance being Fe and incidental impurities, and satisfying Formulae (1) and (2):

$$3.0[\%\ Si]+9.2[\%\ Cr]+10.3[\%\ Mn]\geq 10.0 \quad (1)$$

$$3.0[\%\ Si]+1.0[\%\ Mn]<1.0 \quad (2)$$

where [% M] represents the content of element M (mass %), a microstructure consisting of ferrite and perlite, and a deformation resistance of the case hardening steel is 779 1VIPa or less, a critical upset ratio of the case hardening steel is 53% or more, and the case hardening steel is a steel bar.

2. The case hardening steel according to claim 1, wherein the chemical composition further contains one or more of Cu: 0.5 mass % or less, Ni: 0.5 mass % or less, and V: 0.1 mass % or less.

3. The case hardening steel according to claim 1, wherein the case hardening steel is a round bar.

4. The case hardening steel according to claim 2, wherein the case hardening steel is a round bar.

* * * * *